US005188160A

United States Patent [19]

Jelic

[11] Patent Number: 5,188,160

[45] Date of Patent: Feb. 23, 1993

[54] HONEYCOMBED SHADE

[75] Inventor: Ralph Jelic, Valencia, Pa.

[73] Assignee: Verosol USA Inc., Pittsburgh, Pa.

[21] Appl. No.: 874,525

[22] Filed: Apr. 27, 1992

[51] Int. Cl.[5] ..... A47H 5/00

[52] U.S. Cl. ..... 160/84.1

[58] Field of Search ..... 160/84.1, 32, 35, 340; 428/116, 118, 188

[56] References Cited

U.S. PATENT DOCUMENTS

| | | | |
|---|---|---|---|
| 1,827,718 | 10/1931 | Whitney | 160/84.1 |
| 3,384,519 | 5/1968 | Froget . | |
| 4,625,786 | 12/1986 | Carter et al. . | |
| 4,673,600 | 6/1987 | Anderson . | |
| 4,676,855 | 6/1987 | Anderson . | |
| 4,685,986 | 8/1987 | Anderson . | |
| 4,861,404 | 8/1989 | Neff . | |
| 4,884,612 | 12/1989 | Schnebly et al. | 160/84.1 |
| 4,974,656 | 12/1990 | Judkins . | |
| 4,999,073 | 3/1991 | Kao et al. | 160/84.1 X |

FOREIGN PATENT DOCUMENTS

| | | | |
|---|---|---|---|
| 13740 | of 1887 | United Kingdom . | |
| 2201583 | 9/1988 | United Kingdom | 160/84.1 |

*Primary Examiner*—David M. Purol

*Attorney, Agent, or Firm*—Buchanan Ingersoll; Lynn J. Alstadt

[57] ABSTRACT

A honeycomb structure in which pleats of a first pleated material are joined to corresponding pleats of a second pleated material by a plurality of ribbons is provided. The first and second pleated materials are positioned so that a pleat of the first pleated material is directed toward and in line with a corresponding pleat of the second pleated material. Opposite pleats of first and second material are thus facing one another and spaced a selected distance apart. A ribbon is affixed to each pair of opposed pleats so that a first portion of the ribbon is affixed to the pleat of first material, a second portion of the ribbon is affixed to the pleat of second material and the portion of the ribbon lying between the first portion and the second portion is disposed in the spaced between the first material and second material. The ribbon has one or more perforations located between the first portion and the second portion for lift cords to run through.

14 Claims, 4 Drawing Sheets

HONEYCOMBED SHADE

BACKGROUND OF THE INVENTION

1. Field of the Invention

This invention relates generally to honeycomb structures and more particularly to honeycomb structures used for window coverings.

2. Description of the Prior Art

Various honeycomb structures are known in the art. For example, in U.S. Pat. No. 3,384,519 to Froget, a honeycomb structure is formed by joining a first material and a generally parallel second material with welded spaced-apart blades. In U.S. Pat. No. 4,861,404 to Neff, a honeycomb product is made in which two pleated sheets are connected by alternately extending legs.

In U.S. Pat. No. 4,685,986 to Anderson, a honeycomb structure is created in which the pleat ends of two sections of pleated material are adhered together. Alternatively, Anderson teaches adhering a bridge-like section of material to the opposite pleat ends.

In U.S. Pat. No. 4,974,656 to Judkins, several methods are shown for making honeycomb structures. One such method, shown in FIG. 5A involves adhering a span of material to each end of a pleat and a lift cord is disposed through a hole formed in the span material.

In any of the aforementioned honeycomb structures, a lift cord is incorporated into the structure when that structure is used as a window shade. It is the practice in the art to dispose the lift cords through the pleated material. Typically, holes are drilled into the pleated material through which the lift cords are disposed. It would be advantageous to locate these holes for the lift cords at the center of the honeycomb structure where the two pleated materials meet. For each of the prior art honeycomb structures noted above, the drilling or punching of the lift cord holes at this center location would be difficult due to the close cell nature of the final product as well as possible gumming of the drill by the applied adhesive.

Alignment problems could be incurred if one attempted to preform a lift cord hole in the pleats or on material spanning the pleats. When the lift cord holes are out of alignment, the lift cord will experience drag against the shade material.

SUMMARY OF THE INVENTION

A honeycomb structure in which pleats of a first pleated material are joined to corresponding pleats of a second pleated material by a plurality of ribbons is provided. The first and second pleated materials are positioned so that a pleat of the first pleated material is directed toward and in line with a corresponding pleat of the second pleated material. Opposite pleats of first and second material are thus facing one another and spaced a selected distance apart. A ribbon is affixed to each pair of opposed pleats so that a first portion of the ribbon is affixed to the pleat of first material, a second portion of the ribbon is affixed to the pleat of second material and the portion of the ribbon lying between the first portion and the second portion is disposed in the space between the first material and second material. The ribbon has one or more perforations located between the first portion and the second portion for lift cords to run through. A ribbon material is chosen that is sufficiently rigid to support the first and second pleated material. When a material, such as a woven fabric, is chosen for the ribbon that is not sufficiently rigid to support the shade then a coating of a rigid substance such as a plastic may be applied to the ribbon.

In a first preferred embodiment, the ribbon is made of a nonwoven fabric and the perforations are formed on the ribbon before the ribbon is affixed to the pleats. The perforations can be drilled, punched or cut and could be circular, perpendicular or any other shape or may be slits formed on the ribbon.

In a second preferred embodiment, the ribbon is made of a woven fabric. In this embodiment, perforations may also be machined into the fabric, but preferably the perforations are inherent in the fabric. Woven fabrics have gaps between the woven threads. The size of those gaps depends upon the weaving process. I can use those fabrics having gaps of sufficient size to provide the perforations necessary for disposing the lift cords through the fabric.

DETAILED DESCRIPTION OF THE PREFERRED EMBODIMENT

Figure 1:
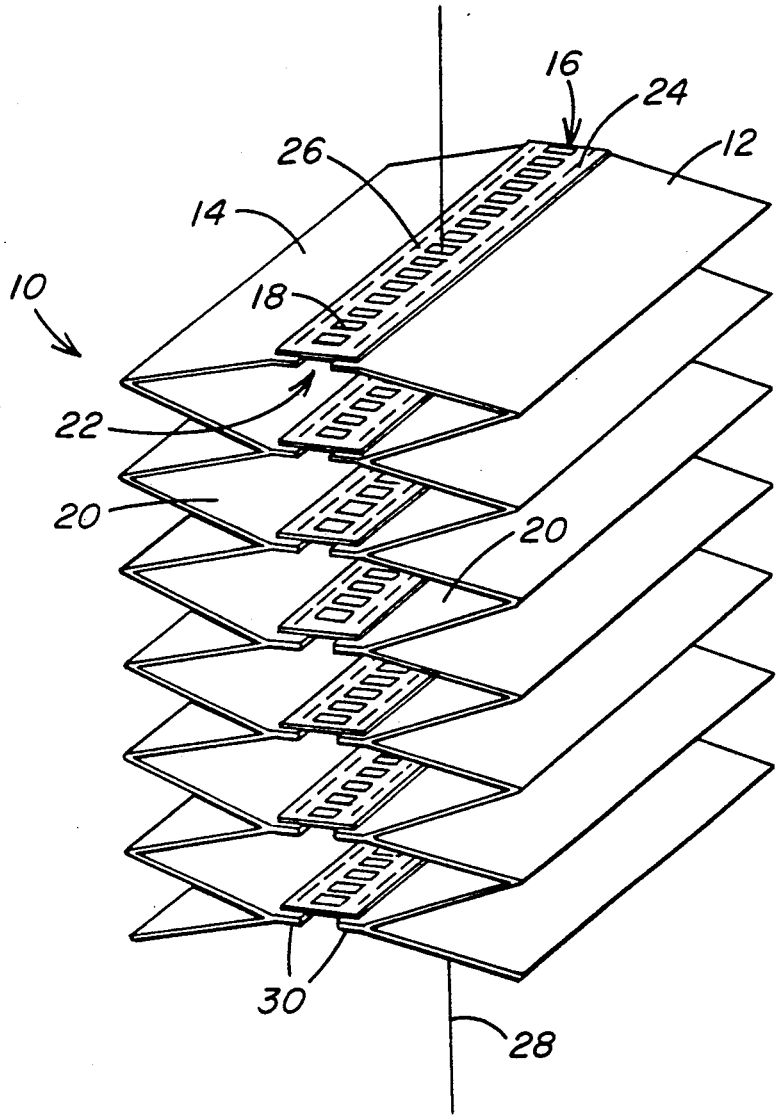
FIG. 1 is a perspective view of a first preferred embodiment of the honeycomb structure.

Referring first to FIG. 1, a first preferred honeycomb structure 10 is shown which is used as a shade for windows. The honeycomb structure 10 has a first pleated material 12 joined to a second pleated material 14 by a ribbon 16 which acts as a bridge-like member. Preferably, the second pleated material 14 faces the interior of the room in which the honeycomb structure 10 is employed. The first pleated material 12 lies generally behind the second pleated material 14 to the rear of the honeycomb structure 10 when the structure is mounted to a window. In the first preferred embodiment, the ribbon 16 is preferably a non-woven fabric having a plurality of closely disposed openings or perforations 18 placed along the length of the ribbon. In this embodiment, the perforations 18 are preformed on the ribbon 16 before the ribbon 16 is bonded to the first pleated material 12 and the second pleated material 14.

In the first preferred embodiment, a first pleated material 12 is provided having a series of transversely arranged pleats 20. First pleated material 12 is preferably made of a nonwoven material such as polyester. A second pleated material 14 is provided that also has a series of transversely arranged pleats 20. Second pleated material 14 is preferably made of a woven material. Each pleat 20 has a distal end 30. The distal end 30 of each pleat 20 may either be the crease of the shade material or a tab (not shown) formed near the crease. Such a tab is formed by securing together pleat material at a short distance from the pleat crease. In forming the tab, the pleat material may be secured together by welding, sewing, gluing, melting or by any convenient means. The first pleated material 12 and second pleated material 14 are arranged so that each pleat 20 of first pleated material 12 is directed toward and is in-line with a corresponding pleat 20 of second material 14. A spacing 22 is provided between each pleat 20 of first pleated material 12 and the corresponding pleat 20 of second pleated material 14, so that while the pleat ends 30 face one another, they are not in contact with one another.

An elongated ribbon 16 is then adhered to the opposed pleats 20 of first pleated material 12 and second pleated material 14. The ribbon 16 of the first preferred honeycomb structure 10 is made of a nonwoven material such as a thin polyester film. The ribbon 16 has a first portion 24 extending along the entire length of the ribbon 16, and extending part way across the width of the ribbon 16 at one side of ribbon 16. The ribbon first portion 24 is adhered to the pleat end 30 of the first pleated material 12. The ribbon 16 is preferably the same approximate length as the pleats 30. The ribbon first portion 24 is adhered to the pleat end 30 of the first pleated material 12 by any convenient means, such as by welding, sewing, gluing or melting.

The ribbon 16 has a second portion 26 extending along the entire length of the ribbon 16 and extending part way across the width of the ribbon 16 at a side of ribbon 16 opposite to the first ribbon portion 24. The ribbon second portion 26 is adhered to the pleat end 30 of the second pleated material 14. The ribbon second portion 26 is adhered to the pleat end 30 of the second pleated material 14 by any convenient means, such as by welding, sewing, gluing or melting.

Figure 2:
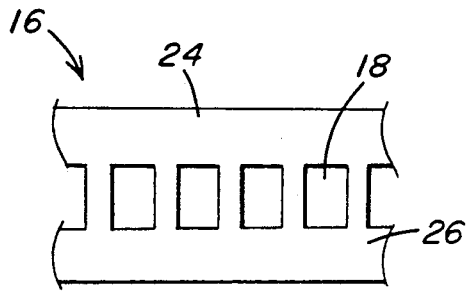
FIG. 2 shows a top plan view of a portion of a first preferred ribbon for use in the first preferred honeycomb structure.
Figure 3:
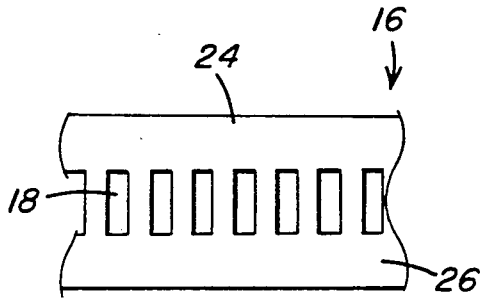
FIG. 3 shows a top plan view of a portion of an alternative ribbon for use in the first preferred honeycomb structure.

Between the first portion 24 and second portion 26 of ribbon 16, a plurality of perforations 18 are disposed. The perforations 18 preferably are located along the entire length of ribbon 16. The perforations 18 shown in FIG. 1 are rectangular and are shown also in FIG. 2. The ribbon perforations 18 of FIGS. 1 and 2 are a series of closely disposed rectangular holes whose width is greater than the width of ribbon material lying between each perforation 18. Thus, the majority of area between the first ribbon portion 24 and second ribbon portion 26 is perforation 18 rather than ribbon material.

Figure 4:
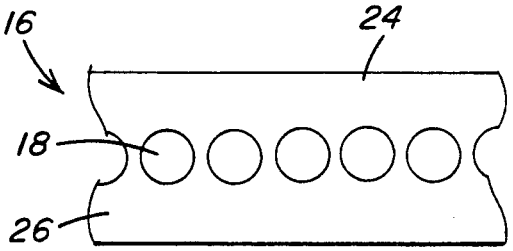
FIG. 4 shows a top plan view of a portion of an alternative ribbon for use in the first preferred honeycomb structure.
Figure 5:
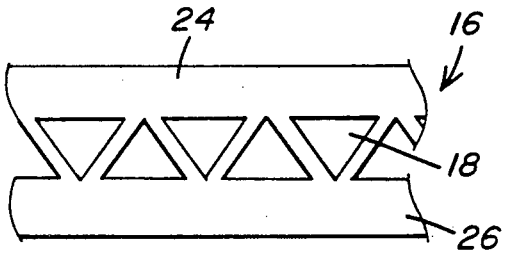
FIG. 5 shows a top plan view of a portion of an alternative ribbon for use in the first preferred honeycomb structure.
Figure 6:
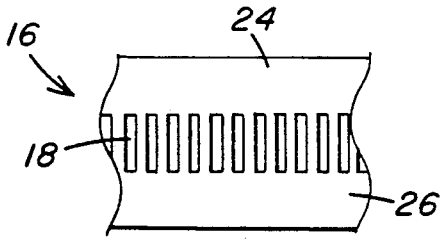
FIG. 6 shows a top plan view of a portion of an alternative ribbon for use in the first preferred honeycomb structure.
Figure 7:
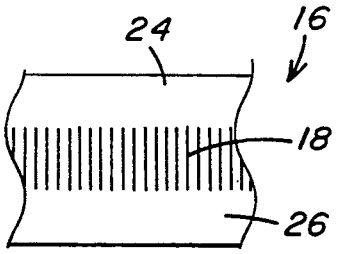
FIG. 7 shows a top plan view of a portion of an alternative ribbon for use in the first preferred honeycomb structure.

Referring next to FIGS. 2 through 7, several alternative designs for the ribbon 16 are shown. In FIG. 4, the width of each rectangular perforation 18 is approximately equal to the width of ribbon material lying between each perforation 18. As can be seen in FIGS. 2 through 7, the amounts of material between each perforation 18 may be changed by the design and positioning of the perforations 18. FIG. 7 shows a ribbon in which the perforations 18 are a series of closely disposed slits in the ribbon material.

Referring again to FIG. 1, as each ribbon 16 is adhered to opposing pleat ends 30, the pleat ends 30 are spaced apart by a selected amount. This spacing 22 between pleat ends 30 provides a path for the lift cords 28 to travel through the honeycomb structure 10. Thus, when ribbon 16 is adhered to the pleat ends 30 of the first pleated material 12 and second pleated material 14, the perforations 18 are disposed between each pleat end 30. A lift cord 28 can then be disposed through colinear perforations 18 and travel between opposed pairs of pleats 20. The plurality of closely arranged perforations 18 along ribbon 16 thus allows placement of the lift cords 28 at a great number of possible locations along the ribbon 16.

Figure 8:
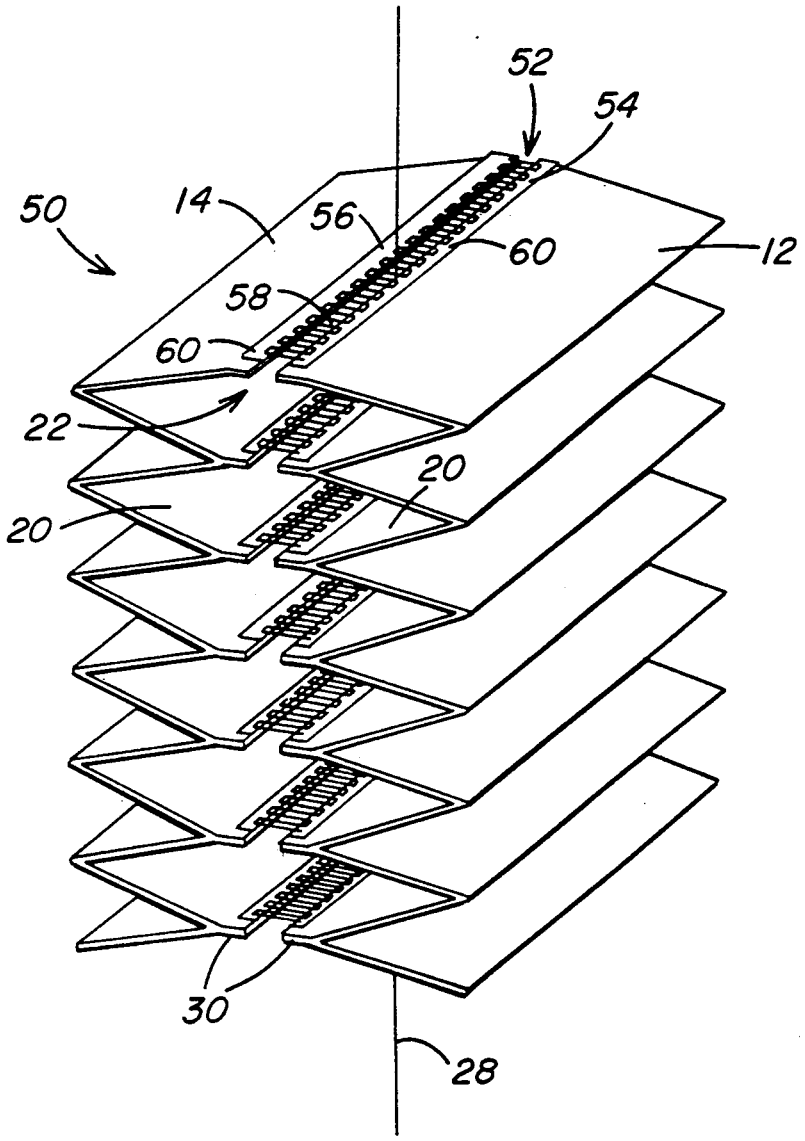
FIG. 8 a perspective view of a portion of a second preferred honeycombed structure.

Referring next to FIG. 8, a second preferred honeycomb structure 50 is shown in which a first pleated material 12 is joined to a second pleated material 14 by a ribbon 52. A first pleated material 12 is provided having a series of transversely arranged pleats 20. A second pleated material 14 is also provided that has a series of transversely arranged pleats 20. Each pleat 20 has a distal end 30. The distal end 30 of each pleat 20 may either be the crease of the shade material or a tab formed near the crease. Such a tab is formed by securing together pleat material at a short distance from the pleat crease. In forming the tab, the pleat material may be secured together by welding, sewing, gluing, melting or by any convenient means. The first pleated material 12 and second pleated material 14 are arranged so that each pleat 20 of first pleated material 12 is directed toward and is in-line with a corresponding pleat 20 of second pleated material 14. A spacing 22 is provided between each pleat 20 of first pleated material 12 and the corresponding pleat 20 of second pleated material 14 so that while the pleats 20 face one another, they are not in contact with one another.

Figure 9:
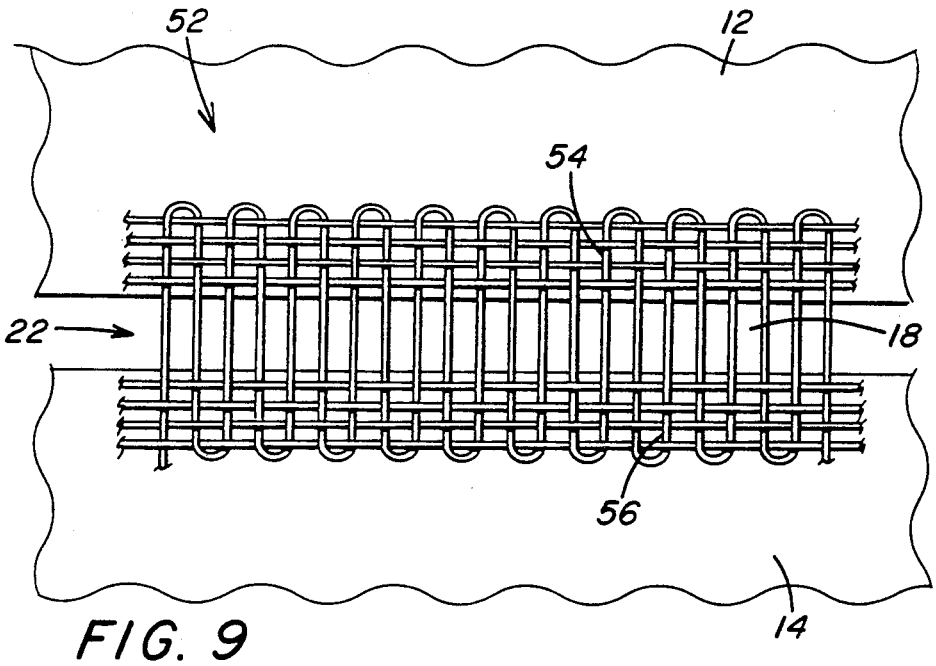
FIG. 9 shows a top plan view of a portion of a second preferred ribbon and attached pleated material.

An elongated ribbon 52, shown in FIGS. 8 and 9, is then adhered to the opposed pleats 20 of first pleated material 12 and second pleated material 14. The ribbon 52 has a first portion 54 extending along the entire length of the ribbon 52, and extending part way across the width of the ribbon 52 at one side of ribbon 52. The ribbon first portion 54 is adhered to the pleat end 30 of the first pleated material 12. The ribbon 52 is preferably the same approximate length as the pleats 20. The ribbon first portion 54 is adhered to the pleat end 30 of the first pleated material 12 by any convenient means, such as by welding, sewing, gluing or melting.

The ribbon 52 has a second portion 56 extending along the entire length of the ribbon 52 and extending part way across the width of the ribbon 52 at a side of ribbon 52 opposite to the first ribbon portion 54. The ribbon second portion 56 is then adhered to the pleat end 30 of the second pleated material 14. The ribbon second portion 56 is adhered to the pleat end 30 of the second pleated material 14 by any convenient means, such as by welding, gluing, sewing or melting.

Between the first portion 54 and second portion 56 of ribbon 52, a plurality of perforations 58 are disposed. In this second preferred embodiment, the ribbon 52 is preferably a woven material. Therefore, inherent in the structure of the material are numerous gaps or perforations 58. The ribbon 52 of the second preferred honeycomb structure 50 is made of a woven material such as woven cotton or nylon thread. The preferred weave pattern involves placing the threads perpendicular to one another. Thus, the perforations 58 formed from this weave pattern are rectangular in shape bordered by the woven threads. However, any perforation shape may be selected for the ribbon 52. The weave pattern can be adjusted so that the portion of the ribbon 52 lying between the first ribbon portion 54 and second ribbon portion 56 has a selected amount of threading providing a selected size of each perforation 58 and a selected amount of ribbon material between each perforation 58.

As each ribbon 52 is adhered to opposing pleat ends 30, the pleat ends 30 are spaced apart by a selected amount. This spacing 22 between pleat ends 30 provides a path for the lift cords 28 to travel through the honeycomb structure 50. Thus, when ribbon 52 is adhered to the pleat ends 30 of the first pleated material 12 and second pleated material 14, the perforations 58 are disposed between each pleat end 30. A lift cord 28 can then be disposed through colinear perforations 58 and travel between opposed pairs of pleats 20. The loose weave of the ribbon material provides a plurality of closely arranged perforations 58 along ribbon 52. The plurality of closely arranged perforations 58 allows placement of the lift cords 28 at a great number of possible locations through the ribbons 52.

For added adhesion to the pleats 20 and for added rigidity of the ribbon 52, a support layer of plastic 60 may be applied to each of the ribbon first portions 54 and ribbon second portions 56. This support layer 60 may be a solid strip or may be applied as a liquid. The support layer 60 is preferably applied to the ribbon 52 before the ribbon 52 is adhered to the pleats 20. However, the support layer 60 may be applied to the ribbon 52 simultaneous to the ribbon 52 being applied to the pleats.

Figure 10:
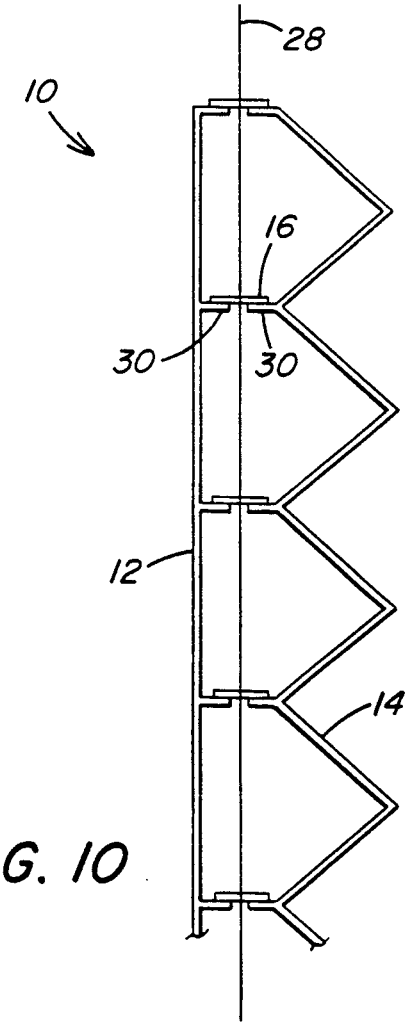
FIG. 10 shows a side view of another present preferred honeycomb structure in a lowered position.

Referring to FIG. 10, for either of the preferred embodiments, it is preferred that the pleats 20 of second material 14 have a greater length than the pleats 20 of first material 12. Thus, when the honeycomb structure is in a fully lowered position, such as by fixing an upper end of the structure and by moving a lower end of the structure away from the upper end, the first pleated material 12 is fully extended. However, since the pleats 20 of second pleated material 14 are longer than the pleats 20 of first pleated material 12, the second pleated material 14 remains creased.

Variations of the preferred embodiments are possible. For example, although the first preferred embodiment preferably employs a ribbon made of a non-woven fabric that has a plurality of perforations preformed on it, a woven fabric may be thus preformed and used.

Furthermore, although the first pleated material is preferably fabricated of a nonwoven material, it may be fabricated of a woven material as well. Similarly, although the second pleated material is preferably fabricated of a woven material, it may be fabricated of a nonwoven material.

Also, although it is preferred that one of the pleated fabrics have a longer pleat length than the other pleated fabric, the pleat lengths of each pleated fabric may be the same.

While certain present preferred embodiments have been shown and described, it is distinctly understood that the invention is not limited thereto but may be otherwise embodied within the scope of the following claims.

I claim:

1. A honeycomb structure comprising:

a first material having a plurality of transverse pleats;

a second material having a plurality of transverse pleats in which each pleat of said second material is directed towards a corresponding pleat of said first material, each pleat of said first material and corresponding pleat of said second material further being spaced a selected distance apart; and a plurality of elongated ribbons, one of each said ribbons connecting one pleat of said first material to a corresponding pleat of said second material, in which a first portion of each said ribbon is affixed to a pleat of said first material and a second portion of each said ribbon is affixed to a corresponding pleat of said second material, each said ribbon further having a plurality of adjacent perforations disposed between the first portion and the second portion so that a lift cord can be threaded through a selected one of a number of perforations in each ribbon.

2. The honeycomb structure of claim 1 wherein said first material is a woven fabric.

3. The honeycomb structure of claim 1 wherein said second material is a nonwoven fabric.

4. The honeycomb structure of claim 1 wherein said ribbons are a woven fabric.

5. The honeycomb structure of claim 4 wherein said ribbon perforations are gaps in the woven fabric.

6. The honeycomb structure of claim 4 wherein a support layer is placed on said ribbon.

7. The honeycomb structure of claim 1 wherein said ribbons are a nonwoven fabric.

8. The honeycomb structure of claim 1 wherein said ribbon perforations are slits.

9. The honeycomb structure of claim 1 wherein said ribbon perforations are holes.

10. The honeycomb structure of claim 1 wherein said ribbons are welded to said first material and said second material.

11. The honeycomb structure of claim 1 wherein said ribbons are affixed to said first material and said second material by an adhesive.

12. The honeycomb structure of claim 1 wherein said ribbons are joined to said first material and said second material by melting.

13. The honeycomb structure of claim 1 wherein said perforations extend along the entire length of said ribbons.

14. The honeycomb structure of claim 1 wherein said pleats of one of said first material and said second material has a length greater than said pleats of said other one of said first material and said second material.

* * * * *